US005966777A

United States Patent [19]

Jantschek

[11] Patent Number: 5,966,777

[45] Date of Patent: Oct. 19, 1999

[54] HINGE

[75] Inventor: Robert J. Jantschek, Stillwater, Minn.

[73] Assignee: Versare Solutions, Inc., Minneapolis, Minn.

[21] Appl. No.: 09/062,332

[22] Filed: Apr. 17, 1998

[51] Int. Cl.[6] ..... E05D 7/00

[52] U.S. Cl. ..... 16/354; 160/229.1; 49/383; 16/366

[58] Field of Search ..... 16/354, 366, 250, 16/251; 160/229.1; 49/383

[56] References Cited

U.S. PATENT DOCUMENTS

| | | | |
|---|---|---|---|
| 1,659,928 | 2/1928 | Townsend | 16/366 |
| 2,072,028 | 2/1937 | Cooper | 16/354 |
| 2,682,722 | 7/1954 | Waller et al. | 16/354 |
| 4,056,985 | 11/1977 | Worrallo | 16/354 |
| 4,443,911 | 4/1984 | Bannister | 16/354 |
| 4,802,467 | 2/1989 | Pansiera | 16/354 |
| 4,916,926 | 4/1990 | Shieh | 16/354 |
| 4,995,144 | 2/1991 | Gateley | 316/366 |
| 5,570,971 | 11/1996 | Rixen et al. | 16/354 |

*Primary Examiner*—Chuck Y. Mah
*Attorney, Agent, or Firm*—Mackall, Crounse & Moore PLC

[57] ABSTRACT

A three point pivoting 360° articulable pinchless hinge connects two members which may pivot 360° with respect to each other. The hinge has two opposing couplers, each having a toothed semicircular portion meshed with the opposing coupler toothed semicircular portion. Each coupler is adapted to be connected to one of the members to be pivoted with respect to each other. A pin is in each coupler extending along an axis of the semicircular portion thereof. A link connects each pin to maintain the meshed engagement of the couplers through 360° of coupler pivotal rotation with respect to each other. The link has a sufficient width substantially that of the width of the coupler body as to block and prevent the meshed semicircular portions from pinching an individual's finger or object.

12 Claims, 4 Drawing Sheets

HINGE

BACKGROUND OF THE INVENTION

This invention relates to a hinge, and more particularly, to a three point pivoting 360° articulable pinchless hinge.

Hinges are well known for connecting members that are to rotate or pivot with respect to each other. One of the members may or may not be stationary. Examples of members that pivot with respect to each other are wall panels and room partitions. Examples where one member stays stationary include doors, gates, lids and covers. The most commonly known hinge is commonly referred to as the piano hinge. The piano hinge may generally be described as having flat or plate portions to be secured along the edges of the respective two members that are to be pivoted with respect to each other. The edges of the hinge plates have fingers or tabs that are formed arcuately into a complete loop portion for capturing a pin or rod. The tabs extending from opposing plates are staggered to permit them to interleave and become aligned with opposing tabs. The aligned looped tabs permit the pin or rod to be captured by the tabs and permit the hinge plates to pivot or rotate with respect to each other.

This type of hinge has two significant drawbacks. Firstly, this hinge structure typically does not permit 360° articulation with respect to the two members but most commonly 180°. Secondly, piano hinges align the edges of the members closely together and, as a consequence, renders the piano style hinge prone to pinching fingers or other objects that happen to get placed in the vicinity of the hinge during such pivotal movement. This is largely because both hinge plate portions are close together and both pivot about a single axis.

FIGS. 1 through 3 show the significant limitations of the prior art hinges. For illustrative purposes, the hinges 6 are connected to wall panels or room partition members 5. Their articulation limitation, typically 180°, requires that the hinges be alternatively arranged as to permit every other panel to alternately rotate in the other direction. This limitation is required to obtain articulation of the panel assembly. Double headed Arrows A and A' generally show the 180° range of articulation of the panels in opposite direction of each other.

The limitation of this type of hinge structure is shown in FIG. 2. Corners 7 and objects, such as building support columns 8, are difficult to articulate the panels 5 with hinges 6 therearound in any type of aesthetically pleasing manner. FIG. 3 shows how every other hinge 6 is restricted beyond their 180° arc of articulation thereby failing to make a perfectly arcuate or serpentine wall arrangement but rather a cornered wall arrangement B.

There is a need for a three point pivoting 360° articulable pinchless hinge that is pinch proof, smooth in operation, positive in its movement and will give the user a full range of choices in positioning of the respective members to be hinged together.

SUMMARY OF THE INVENTION

A three point pivoting 360° articulable pinchless hinge connects two members which may pivot 360° with respect to each other. The hinge has two opposing couplers, each having a toothed semicircular portion meshed with the opposing coupler toothed semicircular portion. Each coupler is adapted to be connected to one of the members to be pivoted with respect to each other. A pin is in each coupler extending along an axis of the semicircular portion thereof. A link connects each pin to maintain the meshed engagement of the couplers through 360° of coupler pivotal rotation with respect to each other. The link has a width substantially that of the width of the coupler body as to block and prevent the meshed semicircular portions from pinching an individual's finger or object.

A principal object and advantage of the present invention is that the hinge permits 360° of smooth articulation for the respective members which are pivotally connected whether both members are to be articulable or one member to be stationary.

Another object and advantage of the present invention is that the hinge has three points of pivoting to make the motion smooth and to space the members apart to prevent pinching.

Another object and advantage of the present invention is that the smooth and positive operations geared meshed arrangement of the hinge readily permits the hinge to support and hold the members in the position to which they are rotated to.

Another object and advantage of the present invention is that the hinge is ideal for use with panels, doors, gates or lids.

Another object and advantage of the present invention is that wall panels or room dividers with the present hinge can be positioned to create perfectly arcuate and serpentine wall structures with the full range of 360° movement of each hinge.

Another object and advantage of the present invention is that significant forces exerted on members connected with the present hinge will not result in tip overs but rather the forces will readily be conveyed from panel member to panel member by the smooth and positive action of the hinges of the present invention.

Other objects and advantages of the present hinge invention will be apparent upon viewing the figures and reviewing the following specification and claims.

DETAILED SPECIFICATION

Figure 1:
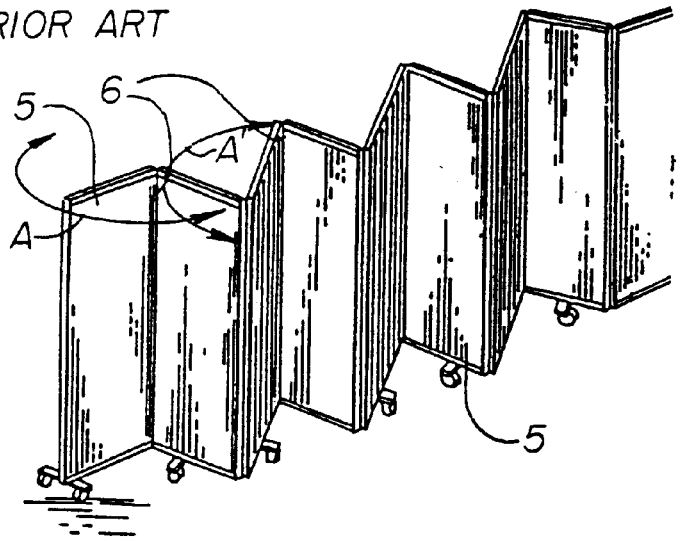
FIG. 1 PRIOR ART
FIG. 1 is a prior art perspective view of room dividers or wall panels commonly connected with piano hinges that fold into an accordion shape.
Figure 2:
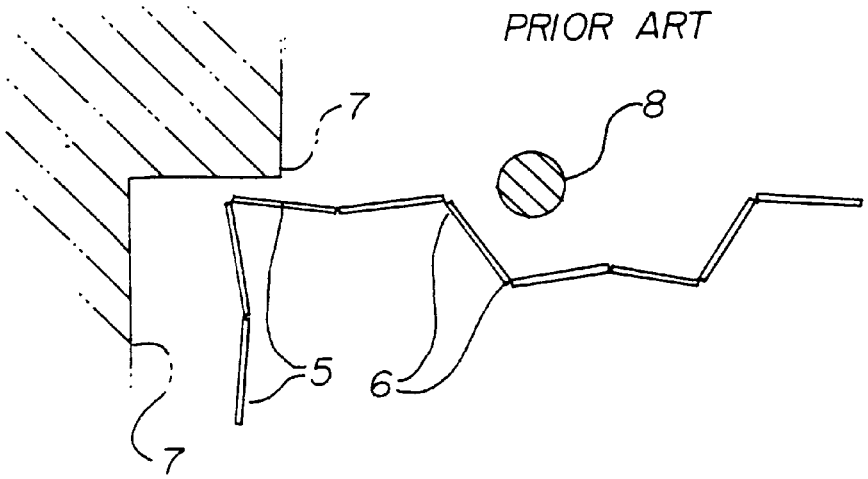
FIG. 2 PRIOR ART
FIG. 2 is a prior art top plan view of the piano hinged room partition panels showing their limitation in movement around objects.
Figure 3:
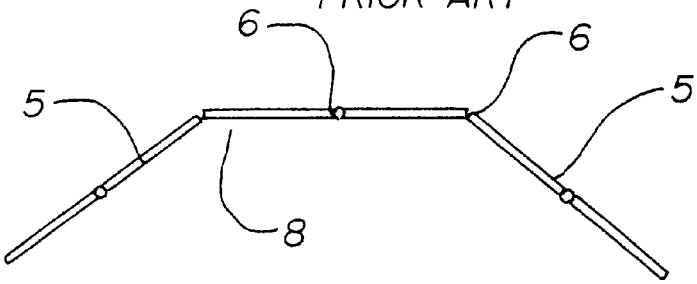
FIG. 3 PRIOR ART
FIG. 3 is a top plan view showing the limited arcuate arrangement of the prior art piano hinges with room dividing panel members.
Figure 4:
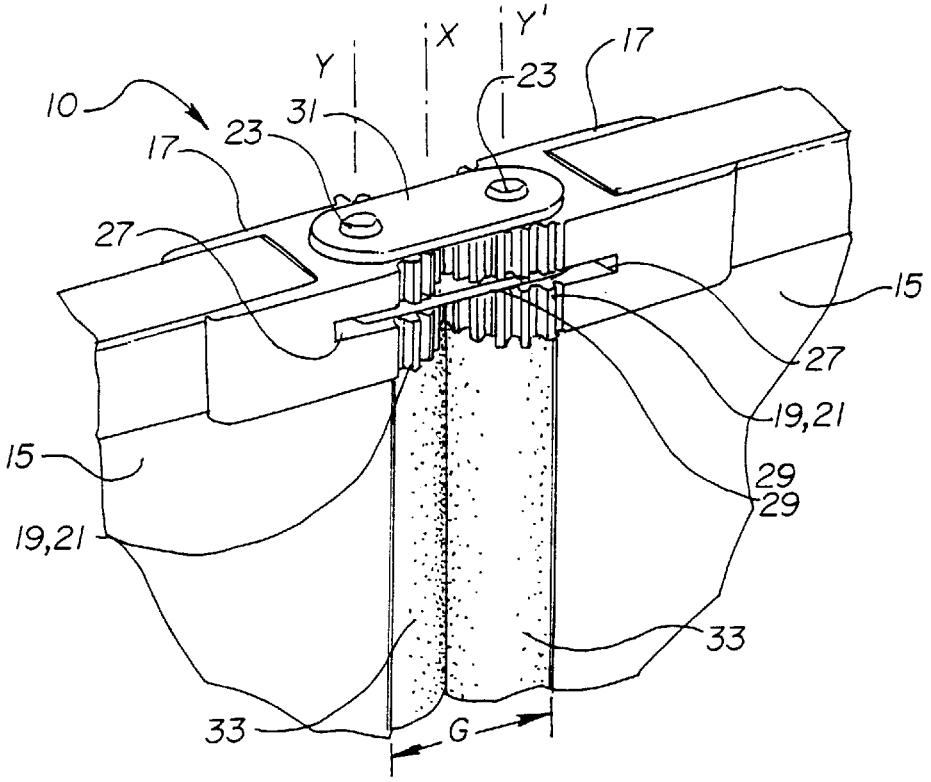
FIG. 4 is a perspective view of the three point pivoting 360° articulable pinchless hinge of the present invention.
Figure 5:
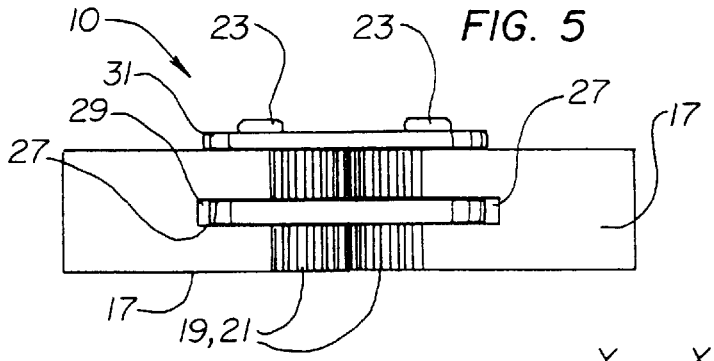
FIG. 5 is a front elevational view, the same as the rear elevational view, of the present hinge.
Figure 6:
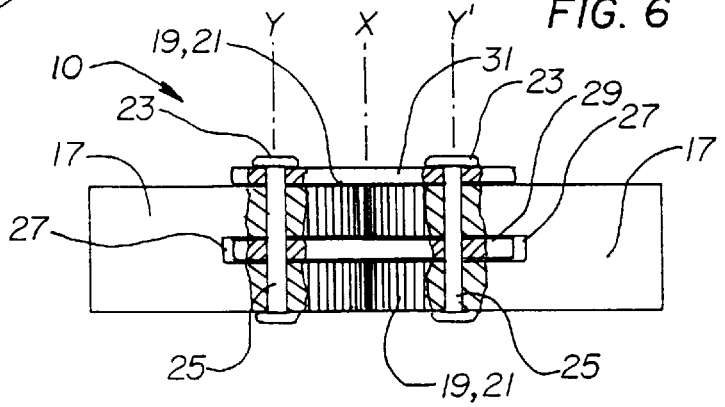
FIG. 6 is a similar view as FIG. 5 with the hinge coupler and link portions broken away for ease of understanding of the pivoting hinge structure.

Referring to FIGS. 4 through 6, the present three point pivoting 360° articulable pinchless hinge 10 may generally be understood. The hinge 10 generally includes two opposing couplers 17, each having a semicircular portion 19 with teeth 21 meshed to the teeth 21 of the opposing coupler's 17 semicircular portion 19. Couplers 17 are suitably adapted to be connected to members 15 to be articulated which may be doors, gates, walls, panels and lids. The connection of the couplers 17 to members 15 may be by conventional means to include screws, pins, rivets or press fit. Each coupler 17 has a pivot pin 23 extending along an axis Y or Y' of one of the semicircular portions 19. A slot 27 is in each coupler extending transversely of the axes Y or Y' and extends through the semicircular portion 19. A link 29 fits in slot 27 and captures the pivot pins 23.

The links are to be of a width substantially that of the width of the couplers 17. Approximately 80% has been found to be acceptable but lesser or more amounts will also suitably work to avoid pinching.

By this arrangement, a gap G is created by members 15 as to avoid pinching. Gap G exists because of the three points or axes X, Y and Y' of pivotal movement. That is, the hinge 10 pivots at pins 23 as well as at the meshing point X of the teeth 21 of semicircular portions 19. These three points of pivoting provide a smooth and positive positioning action for the hinge 10. The gap G may be closed by opposing semicircular sponge-like portions 33 as is shown.

FIG. 6 is a partially blown away front elevational view of the hinge 10. The apertures 25 extend through the semicircular portions 19 along axis Y and Y'. Pins 23 may be placed in apertures 25 and have their ends peened over for securing the pins 23 in the apertures 25. Link 29 is placed within the slot 27 and the second link 31 is placed on top of the couplers 17 before the pivot pins 23 have their ends peened over or are otherwise secured in the semicircular portions 19.

Figure 7:
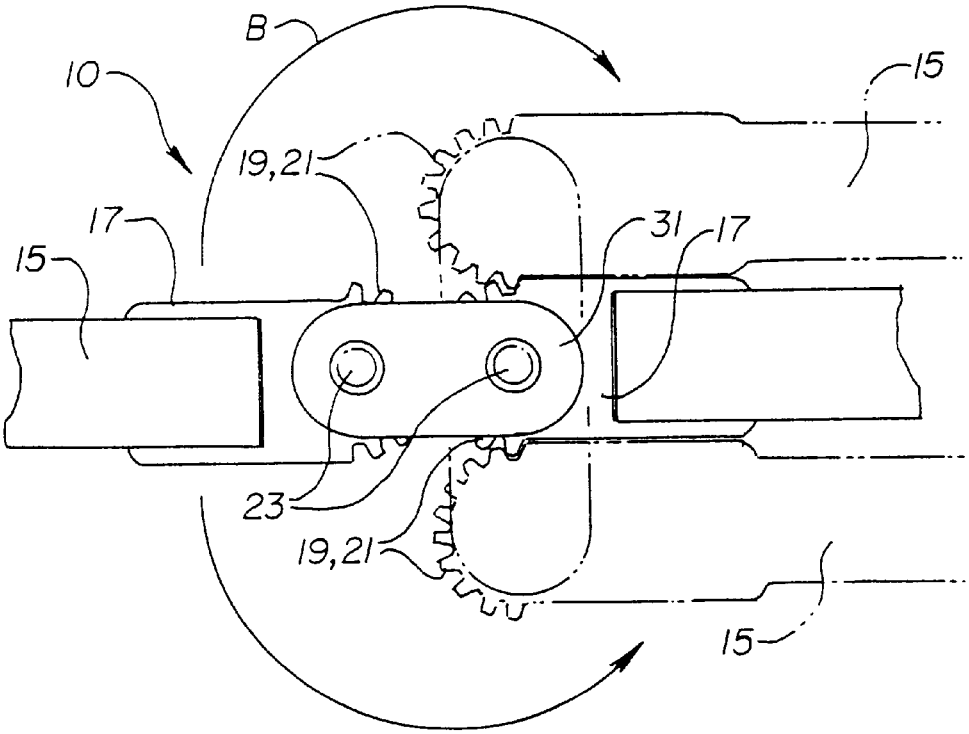
FIG. 7 is a top plan view showing the 360° movement of the hinge with starting and finishing positions in phantom outline.
Figure 8:
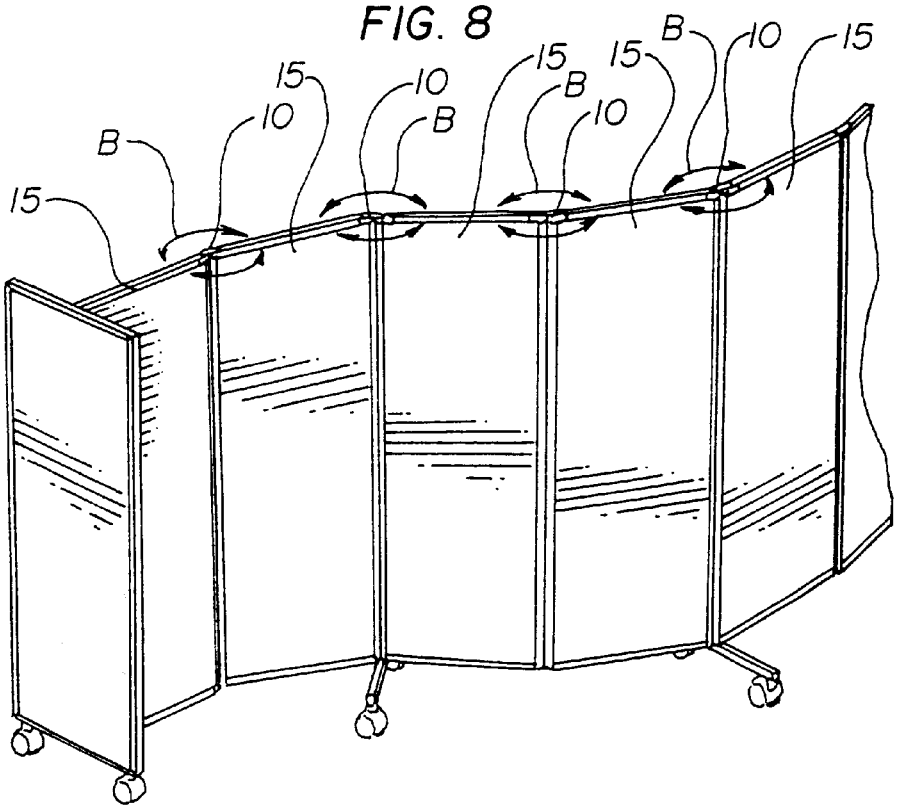
FIG. 8 is a perspective view of the present hinge in use with room divider panels showing the smooth arcuate and serpentine wall panel structure that is available with the hinge of the present invention.

FIG. 7 shows the articulable pivoting motion of the couplers 17 with respect to each other throughout the 360° of articulable movement. This advantageous movement is further shown in FIG. 8 which permits panels or the like to have a perfect arcuate or serpentine relationship between numbers as heretofore not known.

Figure 9:
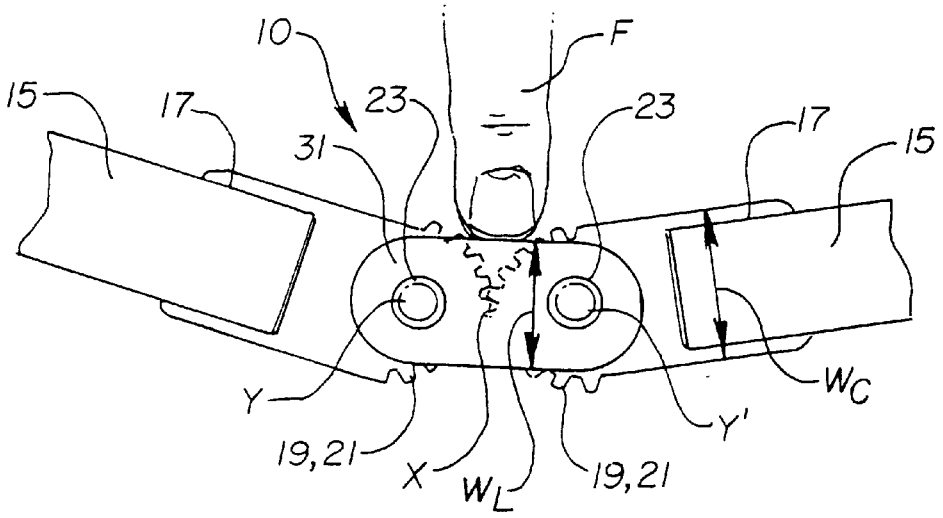
FIG. 9 is a top plan view showing the pinchless nature of the present hinge by way of the substantially wide links.

Referring to FIG. 9, the pinchless quality of the hinge itself may be appreciated. The width $W_L$ of link 29 in relation to the width $W_C$ of the body of coupler 17 is approximately 80% of the width of the coupler 17 to ensure that an individual's finger F cannot be pinched by the meshing teeth 21. Variations up to plus or minus 15% will also suitably prevent pinching to some lesser degree depending upon the size of the finger or obstruction. FIG. 4 illustrates that the gap G is approximately ¾" so as to not pinch fingers. The semicircular sponge portions 33 that oppose each other will simply collapse upon the pinching of a finger F.

Figure 10:
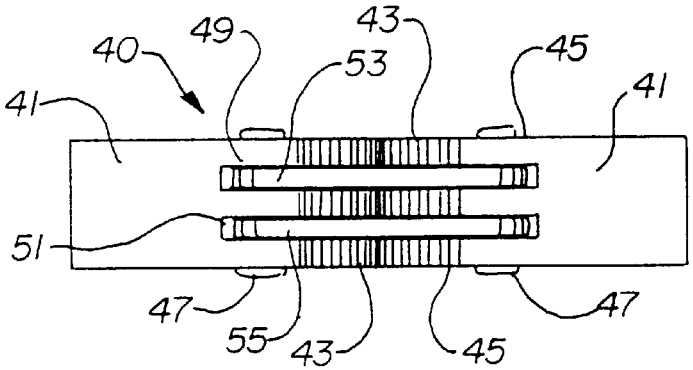
FIG. 10 is a front elevational view, the same as the rear elevational view, of another embodiment of the present invention.

Referring to FIG. 10, another embodiment of the present invention may be seen. Hinge 40 has couplers 41 with semicircular portions 43 with meshed teeth 45. Pivot pins 47 are in each coupler 41 at the axis of each semicircular portion 43. In this arrangement, first slot 49 and second slot 51 are provided for locating first connecting link 53 and second connecting link 55 respectively. This construction offers further protection to prevent an individual's finger F from coming into contact with the meshing teeth 45 to offer a pinchless construction.

Figure 11:
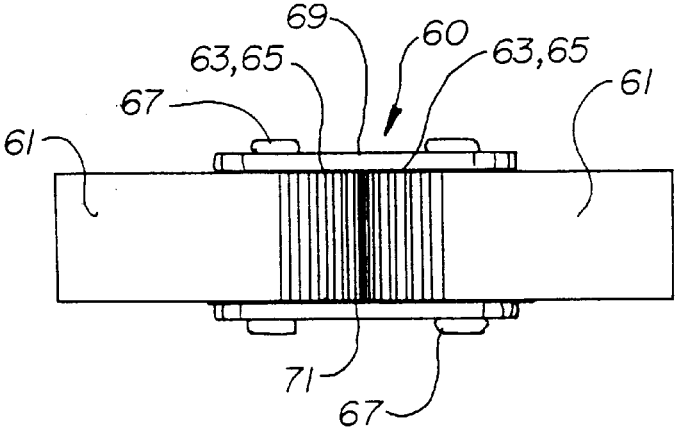
FIG. 11 is a front elevational view, the same as the rear elevational view, of yet another embodiment of the present invention.

Referring to FIG. 11, another embodiment of the pinchless hinge 60 is shown. Hinge 60 includes coupler 61 each with a semicircular portion 63 with meshing teeth 65. Pivot pins 67 go through the axis of the semicircular portions 63. This construction does not have slots as the previous embodiments. Rather first link 69 and second link 71 are placed on top and below the couplers 61 and are captured by pivot pin 67. This construction may offer the same pinchless construction without the need for machining or otherwise creating of slots.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed:

1. A three point pivoting 360° articulable pinchless hinge for connecting two members which may pivot 360° with respect to each other, the hinge comprising:

(a) two opposing couplers, each coupler having a toothed, semicircular portion meshed with the opposing coupler toothed semicircular portion and each coupler adapted to be connected to one member;

(b) a pin in each coupler extending along an axis of the semicircular portion; and (c) a link connecting each pin to maintain the meshed engagement of the couplers through 360° of coupler pivotal rotation with respect to each other, the link having a width substantially that of the width of the coupler as to block and prevent the meshed semicircular portions from pinching an individual's finger.

2. The hinge of claim 1, further comprising a slot in each coupler extending transversely of the axis and through the semicircular portions wherein the link is within the slot.

3. The hinge of claim 2, further comprising a second link connecting each pin.

4. The hinge of claim 1 wherein the pin is fit within an aperture along and through the axis.

5. The hinge of claim 1, further comprising a second link connecting each pin.

6. The hinge of claim 1, further comprising two slots in each coupler extending transversely of the axis and through the semicircular portions wherein the first link is within the slot and a second link connecting each pin is in the second slot.

7. A three point pivoting 360° articulable pinchless hinge for connecting two members which may pivot 360° with respect to each other, the hinge comprising:

(a) two opposing couplers, each coupler having a toothed, semicircular portion meshed with the opposing coupler toothed semicircular portion and each coupler adapted to be connected to one member;

(b) a pin in each coupler extending along an axis of the semicircular portion;

(c) a slot in each coupler extending transversely of the axis and through the semicircular portion; and (d) a link in the slots connecting each pin to maintain the meshed engagement of the couplers through 360° of coupler pivotal rotation with respect to each other, the link having a width substantially that of the width of the coupler as to block and prevent the meshed semicircular portions from pinching an individual's finger.

8. The hinge of claim 7, further comprising a second link connecting each pin.

9. The hinge of claim 7, wherein the pin is fit within an aperture along and through the axis.

10. The hinge of claim 7, further comprising a second link connecting each pin.

11. The hinge of claim 7, further comprising a second slot in each coupler extending transversely of the axis and through the semicircular portions wherein the first link is within one slot and a second link connecting each pin is in the second slot.

12. A three point pivoting 360° articulable pinchless hinge for connecting two members which may pivot 360° with respect to each other, the hinge comprising:

(a) two opposing couplers, each coupler having a toothed semicircular portion meshed with the opposing coupler toothed semicircular portion and each coupler adapted to be connected to one member;

(b) a pin in each coupler extending along an axis of the semicircular portion;

(c) a slot in each coupler extending transversely of the axis and through the semicircular portion; and (d) a first link in the slots connecting each pin to maintain the meshed engagement of the couplers through 360° of coupler pivotal rotation with respect to each other, a second link connecting each pin to further maintain meshed engagement of the couplers, the links having a width substantially that of the width of the coupler as to block and prevent the meshed semicircular portions from pinching an individual's finger.

* * * * *